United States Patent [19]

Focke et al.

[11] Patent Number: 4,615,494

[45] Date of Patent: Oct. 7, 1986

[54] DEVICE FOR RECEIVING REELS

[75] Inventors: Heinz Focke, Verden; Bernhard Focke, Bremen, both of Fed. Rep. of Germany

[73] Assignee: Focke & Co. (GmH & Co.), Verden, Fed. Rep. of Germany

[21] Appl. No.: 671,380

[22] Filed: Nov. 14, 1984

[30] Foreign Application Priority Data

Nov. 22, 1983 [DE] Fed. Rep. of Germany ..... 3342080

[51] Int. Cl.[4] ..... B65H 16/04

[52] U.S. Cl. ..... 242/68.3

[58] Field of Search ..... 242/68.3, 72 R, 68.1, 242/68.2, 72.1; 279/2 R, 2 A, 106, 107, 109; 269/48.1

[56] References Cited

U.S. PATENT DOCUMENTS

| | | | |
|---|---|---|---|
| 2,559,942 | 7/1951 | Casella | 279/2 R |
| 2,622,814 | 12/1952 | Benke | 242/68.3 |
| 2,734,691 | 2/1956 | Godat | 242/72 |
| 2,882,078 | 4/1959 | MacDonald | 242/68.3 |
| 2,922,592 | 1/1960 | Kaltenbach | 242/72 X |
| 3,025,071 | 3/1962 | Larrad | 242/72 |
| 4,366,932 | 1/1983 | Focke | 242/68.3 X |
| 4,441,662 | 4/1984 | Seragnoli | 242/68.3 X |

FOREIGN PATENT DOCUMENTS

| | | | |
|---|---|---|---|
| 925403 | 10/1955 | Fed. Rep. of Germany | 242/72 |
| 1209841 | 2/1965 | Fed. Rep. of Germany | 242/72 |

*Primary Examiner*—John M. Jillions

*Attorney, Agent, or Firm*—Sughrue, Mion, Zinn, Macpeak, and Seas

[57] ABSTRACT

For the rotatable mounting of reels (15), especially in conjunction with packaging machines, there is a reel-receiving device, in which the reel (15) supported on a hub (11) is pressed against the reel (15) or against its (cardboard) core (16) by clamping claws (20) designed and actuated in a special way. The clamping claws (20) are preferably designed so that they partially press into the material of the core (16) and secure the latter positively against rotation.

12 Claims, 4 Drawing Figures

DEVICE FOR RECEIVING REELS

The invention ralates to a device for receiving reels (a wound sheet of material) driven to rotate, with a hub on which the reel is supported by means of a central orifice, and with a releasable retention means for fixing the reel temporarily on the hub.

Reels of packaging material are required for packaging machines. The reels must be supported in such a way that, when they are rotated, the sheet of packaging material can be drawn off continuously. At the same time, it is desirable that the reel itself should not rotate on the hub, but that the latter should rotate together with the reel.

In a known design of a reel-receiving device No. (EP-A-25,563), the reel is fixed to the hub by means of a union nut. The union nut has assigned to it a circular pressure disk which can be pressed against the reel because of the tightening of the union nut.

The union nut functioning as a clamping or retaining member is relatively complicated to handle. This has an adverse effect, above all, when, as occurs in packaging machines, the reels have to be renewed frequently because of the high consumption of material. In addition, the pressure disk resting against the reel impedes the run-off of the sheet of material from the reel, when the region covered by the pressure disk is moved.

The object on which the invention is based is to propose a reel mounting or receiving device which is simple and reliable in terms of both construction and handling and which guarantees that the reel is fixed faultlessly on the hub.

To achieve this object, the reel-receiving device according to the invention is defined in that at least one clamping claw can be pressed with spring elasticity against an inner region of the reel, especially against a sleeve-shaped (cardboard) core, and can be moved out of the retaining position against the elastic force by means of an adjusting member.

In the reel-receiving device according to the invention, retaining members (clamping claws) are pressed against the inner region, especially solely against the (cardboard) core, specifically preferably by means of (compression) springs. The clamping claws acting on one side press the reel or the sleeve-shaped core against an abutment disk and thereby fix the reel.

To remove the emptied reel and to push a new one on, the clamping claws are moved back from the clamping position, in such a way that they are located within the cross-sectional region of the hub. The reel can consequently be changed without obstruction.

According to a further important proposal of the invention, the clamping claws are moved into the retracted position, against the load of the springs, by means of a pressure medium. The pressure medium, especially compressed air, acts on an adjusting member common to several, especially three clamping claws.

To ensure that rotary movements of the reel on the hub, that is to say relative to the latter, are prevented, the retaining or clamping member for the reel, that is to say, in particular, clamping claws, are designed so that they partially penetrate positively into the (cardboard) core as a result of the pressure acting axially. When clamping claws are used, these are designed with bevelled edges which penetrate into notches of the core, at the same time with deformation of the material.

Further features of the invention relate to the design of the clamping claws and to the actuation of these and to the mounting of the hub.

An exemplary embodiment of the invention is explained in more detail below with reference to the drawings in which.

Figure 1:
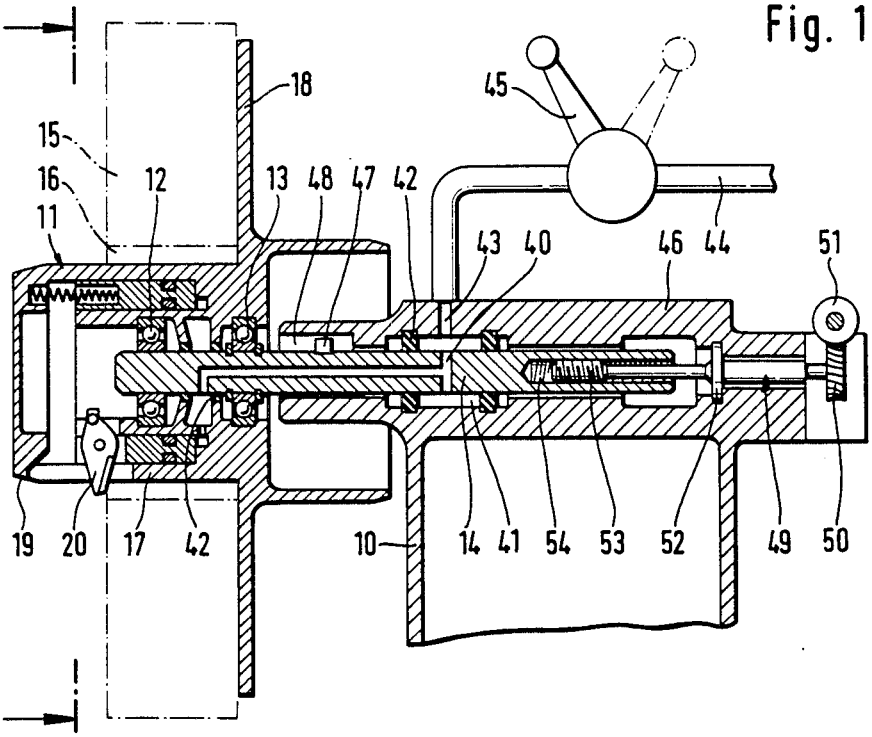
FIG. 1 shows a reel-receiving device in a longitudinal section.

The reel-receiving device illustrated as a preferred exemplary embodiment in the drawings is arranged on a machine frame 10 of, for example, a packaging machine. A hub 11 is mounted rotably, via two ball bearings 12 and 13 arranged at a distance from one another, on a supporting journal 14 projecting from the machine frame 10 and supported in this.

A reel 15 is received on the hub 11. This reel sits on a cylindrical supporting part 17 of the hub 11 by means of a sleeve-shaped (cardboard) core 16. This supporting part is limited, on the side facing the machine frame 10, by an abutment disk 18 against which the reel 15 is pressed in the working position. The end of the hub 11 or of the supporting part 17 located opposite the abutment disk 18 is free of projections and, to make it easier to push the reel 15 on, is designed with a chamfer 19 located at the edge.

Figure 2:
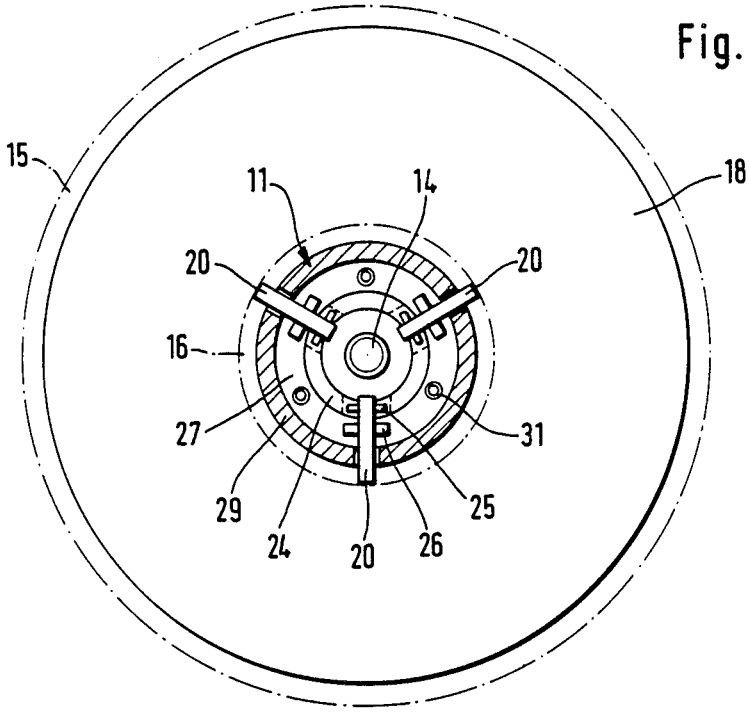
FIG. 2 shows the reel-receiving device according to FIG. 1 in a cross-sectional view taken along the dot-dash section line of FIG. 1.

In the working position (FIGS. 1 and 4), the reel 15 is fixed on the supporting part 17 by means of movable retaining members, in particular clamping claws 20 mounted pivotably. In the present exemplary embodiment, as can be seen in FIG. 2, three clamping claws 20 of this type are attached to the hub 11, distributed at equal angular distances from one another.

Figure 3:
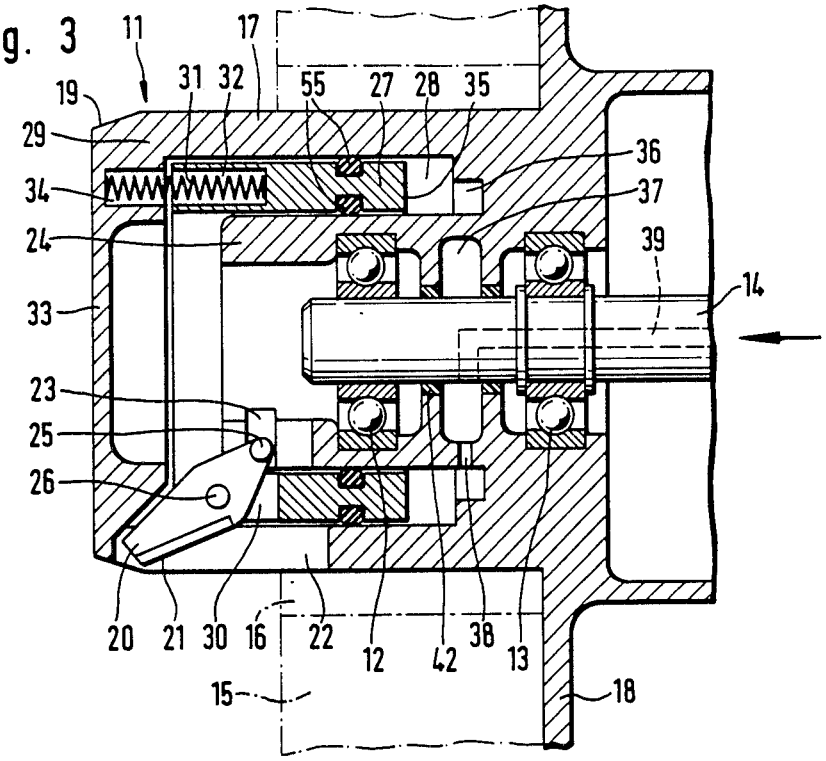
FIG. 3 shows a detail of the reel-receiving device, in particular a hub, in axial section and on an enlarged scale.
Figure 4:
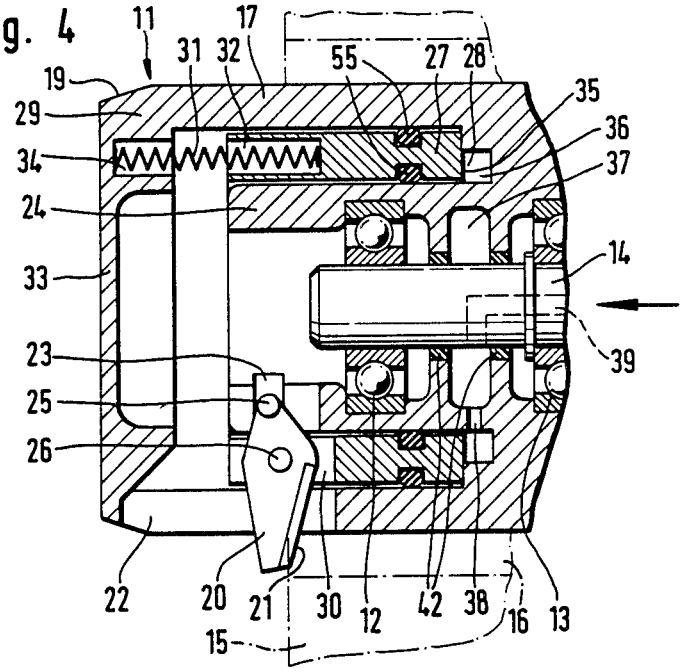
FIG. 4 shows the detail according to FIG. 3 in a changed relative position.

The clamping jaws 20 are each designed as a pivotable (two-armed) lever and are mounted in such a way that they are pivotable between a retracted position according to FIG. 3, allowing the reels 15 to be changed, and a clamping or retaining position according to FIG. 4. In the retracted position (FIG. 3), the clamping claws 20 have disappeared completely within the cross-section of the hub 11 or of the supporting part 17. In a clamping position (FIG. 4), the clamping jaws 20 are directed approximately radially. A clamping edge 21 of the clamping jaw 20, this clamping edge facing the reel 15 of the core 16, is inclined, that is to say at an acute angle to the radial direction. Furthermore, the clamping edge 21 is bevelled in the form of a wedge or in the manner of a knife. As a result of the clamping force exerted on the clamping claws 20, the clamping edge 21 is pressed into the (cardboard) core 16, at the same time with corresponding deformation of the latter, to form an appropriate notch. As a result, the core 16 is retained positively by the clamping claws 20 and fixed against relative rotation on the supporting part 17.

The clamping claws 20 are mounted within the hub 11 or the cylindrical supporting part 17. For this purpose, axially directed slots 22 are provided in the supporting part 17, in the region of the clamping claws 20, for the passage of the latter. The end of the lever-shaped clamping claws 20 which is located opposite the clamping end or the clamping edges 21 is mounted movably on the supporting part 17, in particular in a radial slot-shaped recess 23 of an inner cylinder 24 of the supporting part 17. A guide pin 25 attached to this end of the clamping jaw 20 slides in the slot-shaped recess 23.

At a distance from this, the clamping claw 20 is mounted rotatably or pivotably by means of a bearing journal 26 on an adjusting or actuating member for the clamping claws 20. This is a sliding sleeve 27 which is mounted so as to be axially displaceable in an annular space 28 of the supporting part 17. The annular space 28 is limited on the inside by the inner cylinder 24 and on the outside by an outer cylinder 29. The bearing journal 26 is located within a longitudinal slot 30 of the sliding sleeve 27, through which the clamping claw 20 also passes. Displacement of the sliding sleeve 27 in the axial direction causes the clamping claws 20 to pivot in the way described, a guide pin 25 sliding in the recess 23 in a radial direction.

The sliding sleeve 27 functioning as an adjusting member for the clamping claws 20 is loaded with spring elasticity in the direction of the clamping position (FIG. 4). In the present case, three (helical compression) springs are arranged distributed at equal angular distances from one another in the peripheral direction. The springs 31 partially penetrate into longitudinal bores 32 (blind bores) in the sliding sleeve 27. The other end of each of the springs 31 is supported on a radial end wall 33 of the hub 11. Appropriate retaining bores 34 are provided in this for guiding the springs 31.

In the present exemplary embodiment, to actuate the clamping claws 20, the sliding sleeve 27 is adjusted by means of a pressure medium, in particular compressed air. The sliding sleeve 27 subjected directly to compressed air acts as an annular cylinder. An end face 35 remote from the springs 31 is subjected to compressed air within the annular space 28 acting as a correspondingly shaped cylinder chamber and is sealed off from the outside by means of gaskets 55.

For supplying the compressed air, a distributor ring 36 adjoining the annular space 28 is formed on the side remote from the sliding sleeve 27. This distributor ring is connected to the annular space 28, on the one hand, and to an intermediate chamber 37, on the other hand, via radial channels 38. The intermediate chamber 37 in the inner cylinder 24 is connected to the compressed-air supply.

Compressed air is supplied via a compressed-air line 39 which is formed (centrally) in the supporting journal 14 and which opens via a radial branch into the intermediate chamber 37 open towards the supporting journal 14. This intermediate chamber is formed between the two ball bearings 12 and 13 of the hub 11 and is sealed off on both sides by means of gaskets 42. Accordingly, in the region of the intermediate chamber 37, the compressed air is conveyed from a fixed supporting part 17 to rotating parts.

To move the clamping claws 20 into the retracted position according to FIG. 3, the sliding sleeve 27 is subjected to compressed air in the way described and is thereby displaced in the axial direction towards the free end of the hub 11. The clamping claws 20 are pivoted (in a clockwise direction) against the springs 31 which are at the same time compressed. To clamp or fix a reel 15 on the supporting part 17, a compressed-air system is vented. Under the effect of the springs 31, the sliding sleeve 27 returns into the position according to FIG. 4, at the same time with a corresponding adjustment of the clamping claws 20.

The intermediate chamber 37 has in the axial direction a dimension which allows certain axial displacements of the hub 11 on the supporting journal 14, as a result of dimensional tolerances, without the branch moving out of the region of the intermediate chamber 37.

In the region of the machine frame 10, the compressed-air line 39 is connected by means of a transverse channel 40 to an annular distributor chamber 41. The latter is limited laterally by gaskets 42. A radial connecting bore 43 connects the distributor chamber 41 to a main line 44 leading to a compressed-air source. A shut-off member 45 (to be actuated manually) is provided in the latter.

The part of the supporting journal 14 remote from the hub 11 is supported in a closed bearing body 46 of the machine frame 10. The distributor chamber 41 is also formed in this. The cylindrical supporting journal 14 is secured against rotation by means of a radial retaining pin 47 in a groove 48 of the bearing body 46.

The present reel mounting allows the hub 11 to be adjusted in such a way that the reel 15 or the sheet of material running off can be adjusted to an exact relative position. For this purpose, the supporting journal 14 is arranged so as to be axially displaceable in the bearing body 46. At the end remote from the hub 11, the supporting journal 14 is connected to a connecting rod 49. The free end of the latter projects from the bearing body 46 and is connected to an adjusting gear. In the present case, this is a worm wheel 50 which is arranged on the connecting rod 49 and which is driven to rotate by means of a worm 51, in order to transmit adjusting movements to the supporting journal 14.

In the present exemplary embodiment, the connecting rod 49 is designed as a spindle 53 with a region penetrating into the supporting journal 14. Its external thread engages with an internal thread of a longitudinal bore 54 in the supporring journal 14. Accordingly, when the connecting rod 49 is rotated, the supporting journal 14 is adjusted with a high degree of sensitivity, without the connecting rod 49 itself executing axial movements. On the contrary, the latter is instead secured by means of a collar 52 arranged on the connecting rod 49 and supported positively within the bearing body 46.

The special design of the clamping claws 20 for the positive fixing of the core 16 and the axially directed adjustability of the supporting journal 14 (adjusting gear) can also be used independently of one another or in a reel mounting designed otherwise and actuated in another way.

We claim:

1. A device for receiving and retaining a rotatable reel (15) capable of carrying sheet material, said reel having a core (16), said reel receiving and retaining device comprising:

a rotatable hub (11) having a supporting part (17) with an outer cylindrical portion (29) for receiving said reel core (16);

at least one clamping claw (20), with a clamping edge (21) to deform said core when the clamping claw is moved to an extended position, for retaining said reel on said hub, said clamping claw being mounted for radial movement to said supporting part of said hub, said clamping claw also being pivotably movable from a retracted position to an extended position where by reason of its extended position it prevents axial movement of said reel and by reason of its clamping edge which deforms the core it prevents rotation of said reel relative to said hub;

means for causing said clamping claw to assume a normally extended position; and a sliding sleeve (27) mounted interior to said hub for causing said clamping claw (20) to move from its normally extended position to its retracted position;

wherein said rotatable hub includes an inner cylindrical portion (24) of said supporting part (17), said sliding sleeve being positioned in an annular space between said outer and inner cylindrical portions (29, 24) and being axially movable therein, said sliding sleeve including a longitudinal slot (30) through which said clamping claw passes, said clamping claw including a bearing journal (26) passing into said longitudinal slot (30) and cooperating with said sliding sleeve such that axial movement of said sliding sleeve causes said clamping claw to pivot between its extended and retracted positions.

2. The reel receiving and retaining device as claimed in claim 1, wherein said means for causing said clamping claw to assume a normally extended position includes a spring means for biasing said sliding sleeve to a position whereat said clamping claw is in the extended position.

3. The reel receiving and retaining device as claimed in claim 2, wherein said inner cylindrical portion (24) includes a radial recess (23) and said clamping claw includes a guide pin 25 radially slidable in said radical recess (23) as said clamping claw pivots in response to the axial movement of said sliding sleeve.

4. The reel receiving and retaining device as claimed in claim 3, wherein said sliding sleeve further includes a bore (32) for receiving one end of said spring means, the opposite end of said spring means being fixed to said hub.

5. the reel receiving and retaining device as claimed in claim 4, further including means for moving said sliding sleeve against the force imparted by said spring means to thereby move the sliding sleeve to a position whereat said clamping claw is in its retracted position.

6. The reel receiving and retaining device as claimed in claim 5, further including a support journal (14) and bearing means for rotatably mounting said hub (11) to said support journal (14).

7. The reel receiving and retaining device as claimed in claim 6, wherein said means for moving the sliding sleeve against the force of said spring means includes a compressed air source, an air line running through said support journal, one end of said air line being connected to said compressed air source, and air pressure chambers for communicating the opposite end of said air line with said sliding sleeve (27), whereby compressed air passes through said air line and said air pressure chambers to force said sliding sleeve to move against the force of said spring means.

8. The reel receiving and retaining device as claimed in claim 1, including a plurality of clamping claws distributed about the periphery of said sliding sleeve.

9. The reel receiving and retaining device as claimed in claim 7, further including gear means for axially adjusting the position of said supporting journal (14).

10. The reel receiving and retaining device as claimed in claim 9, wherein said gear means includes a worm drive (51) connected to a worm wheel (50), said worm wheel being arranged on a connecting rod (49) coupled through a spindle (53) and bore (54) to said supporting journal (14).

11. A device for receiving and retaining a rotatable reel (15) capable of carrying sheet material, said reel having a core (16), said reel receiving and retaining device comprising:

a rotatable hub (11) having a supporting part (17) with an outer cylindrical portion (29) for receiving said reel core (16);

at least one clamping claw (20) for retaining said reel on said hub, said clamping claw being mounted for radial movement to said supporting part of said hub, said clamping claw also being pivotably movable from a retracted position to an extended position where by reason of its extended position it prevents axial movement of said reel;

means for causing said clamping claw to assume a normally extended position;

a sliding sleeve (27) mounted interior to said hub for causing said clamping claw (20) to move from its normally extended position to its retracted position;

said rotatable hub including an inner cylindrical portion (24) of said supporting part (17), said sliding sleeve being positioned in an annular space between said outer and inner cylindrical portions (29, 24) and being axially movable therein; and means pivotably mounting said clamping jaw on said sliding sleeve so that said clamping jaw is pivoted into said extended and retracted positions by the axial movement of said sliding sleeve.

12. The device as claimed in claim 11 wherein said sliding sleeve includes a longitudinal slot (30) through which said clamping claw passes, said clamping claw including a bearing journal (26) passing into said longitudinal slot (30) and cooperating with said sliding sleeve such that axial movement of said sliding sleeve causes said clamping claw to pivot between its extended and retracted positions.

* * * * *